US008191347B2

(12) United States Patent
Nagode

(10) Patent No.: US 8,191,347 B2
(45) Date of Patent: Jun. 5, 2012

(54) METHOD AND APPARATUS FOR INDICATING THE APPROACH TO THE END OF A ROPE

(76) Inventor: Steve Nagode, Federal Way, WA (US)

( * ) Notice: Subject to any disclaimer, the term of this patent is extended or adjusted under 35 U.S.C. 154(b) by 42 days.

(21) Appl. No.: 12/587,150

(22) Filed: Oct. 1, 2009

(65) Prior Publication Data

US 2011/0078994 A1 Apr. 7, 2011

(51) Int. Cl.
*D02G 3/22* (2006.01)

(52) U.S. Cl. ..... 57/210

(58) Field of Classification Search ..... 57/3, 200, 57/210; 87/1, 5, 13; D21/672
See application file for complete search history.

(56) References Cited

U.S. PATENT DOCUMENTS

| | | | | | |
|---|---|---|---|---|---|
| 2,328,500 | A | | 8/1943 | Salsas | |
| 3,486,409 | A | | 12/1969 | Powell | |
| 3,537,418 | A | | 11/1970 | Brownson | |
| 3,914,825 | A | * | 10/1975 | Reynolds | 24/115 R |
| 4,179,160 | A | * | 12/1979 | Sabo | 116/205 |
| 4,375,886 | A | * | 3/1983 | Muys | 482/82 |
| 4,385,759 | A | * | 5/1983 | Everroad | 482/82 |
| 4,456,451 | A | * | 6/1984 | Vosper | 425/392 |
| 4,519,643 | A | | 5/1985 | Harris | |
| 4,572,464 | A | | 2/1986 | Phillips | |
| 4,735,035 | A | | 4/1988 | Mattioli | |
| 4,832,289 | A | | 5/1989 | Waggoner | |
| 4,844,000 | A | * | 7/1989 | Clement | 116/205 |
| 5,060,549 | A | | 10/1991 | Beal | |
| 5,236,405 | A | | 8/1993 | Dohmann et al. | |
| 5,341,758 | A | * | 8/1994 | Strickland | 114/253 |
| 5,829,242 | A | | 11/1998 | Berglund | |
| D407,450 | S | * | 3/1999 | Janet | D21/672 |
| 5,988,101 | A | * | 11/1999 | Jacobs et al. | 116/205 |
| 6,375,139 | B1 | | 4/2002 | Murray et al. | |
| 7,047,860 | B2 | | 5/2006 | Faborsky | |
| 2003/0148859 | A1 | * | 8/2003 | Chun | 482/82 |
| 2005/0183304 | A1 | * | 8/2005 | Kennedy et al. | 40/601 |
| 2007/0034400 | A1 | * | 2/2007 | Rivera | 174/138 G |
| 2007/0158096 | A1 | * | 7/2007 | Katz et al. | 174/111 |
| 2008/0000572 | A1 | | 1/2008 | Lopez | |
| 2011/0078994 | A1 | | 4/2011 | Nagode | |

FOREIGN PATENT DOCUMENTS

| | | | |
|---|---|---|---|
| DE | 19708029 | C | 9/1998 |
| EP | 0383702 | A | 8/1990 |
| FR | 2847821 | A | 6/2004 |
| GB | 189724766 | A | 0/1898 |
| GB | 1329253 | A | 9/1973 |

OTHER PUBLICATIONS

European Search Report, EP11151104, mailed Jul. 7, 2011, Steve Nagode, 13 pages.

(Continued)

*Primary Examiner* — Shaun R Hurley
(74) *Attorney, Agent, or Firm* — Chernoff, Vilhauer McClung & Stenzel LLP

(57) ABSTRACT

A device for indicating the approach of the end of a rope includes a stiffening mechanism located at or near the end of the rope which is sufficiently stiff and sufficiently long to warn a user moving along the rope that he is approaching its end, and the method of using such a rope.

14 Claims, 3 Drawing Sheets

OTHER PUBLICATIONS

Anonymous: "White Line : Rope's end protectors", Internet Article, Nov. 4, 2008, XP002634815, Retrieved from the Internet: URL:http://replay.web.archive.org/20081104122232/http://www.arolyth.se/txrpeng.html [retrieved on Apr. 28, 2011].

Anonymous: "Beal Rope End Marking it—50 pieces", Internet Article, Nov. 11, 2008, XP002634816, Retrieved from the Internet: URL:http://www.abaris.co.uk/index.php?main_page=product_info&products_id=161 [retrieved on Apr. 28, 2011].

* cited by examiner

METHOD AND APPARATUS FOR INDICATING THE APPROACH TO THE END OF A ROPE

BACKGROUND OF THE INVENTION

In many applications it is desirable that ropes have an identifying indicia located near their end, for example, when ropes are used to ascend or descend a rock wall, a mountain, a building or the like, a single rope may not be long enough to cover the entire distance. In this situation it is desirable that the rope have such an indicia located at or near its ends to inform the user that he is approaching the end of the rope so that he will not accidentally become separated from the rope. One way this is accomplished is by placing one or more knots in the rope at or near its lower end. This is effective, but it is a manual solution. Forgetting to tie knots at the ends of the ropes can be disastrous. In addition some climbers choose not to tie knots at the ends of their ropes, for fear that a knot will cause the rope to become stuck on an obstruction. When climbing, a climber ties into the end of the rope. If the knot they use for this is too close to the end of the rope or is inadvertently not tightened, it could work its way off of the end of the rope.

SUMMARY OF THE INVENTION

The subject invention provides a rope having a stiffening mechanism located at or near its end. The stiffening mechanism causes a segment of the rope to be sufficiently stiff and have a sufficient length that the segment will not significantly bend and that a person moving hand to hand along the rope will perceive the segment when it is reached.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

The following description refers to a rope and particularly to a rope used for climbing purposes. However, the subject invention can be used in conjunction with any flexible line where it is desirable to mark the end of the line. Accordingly when used here in the term rope referring to any such line.

Figure 1:
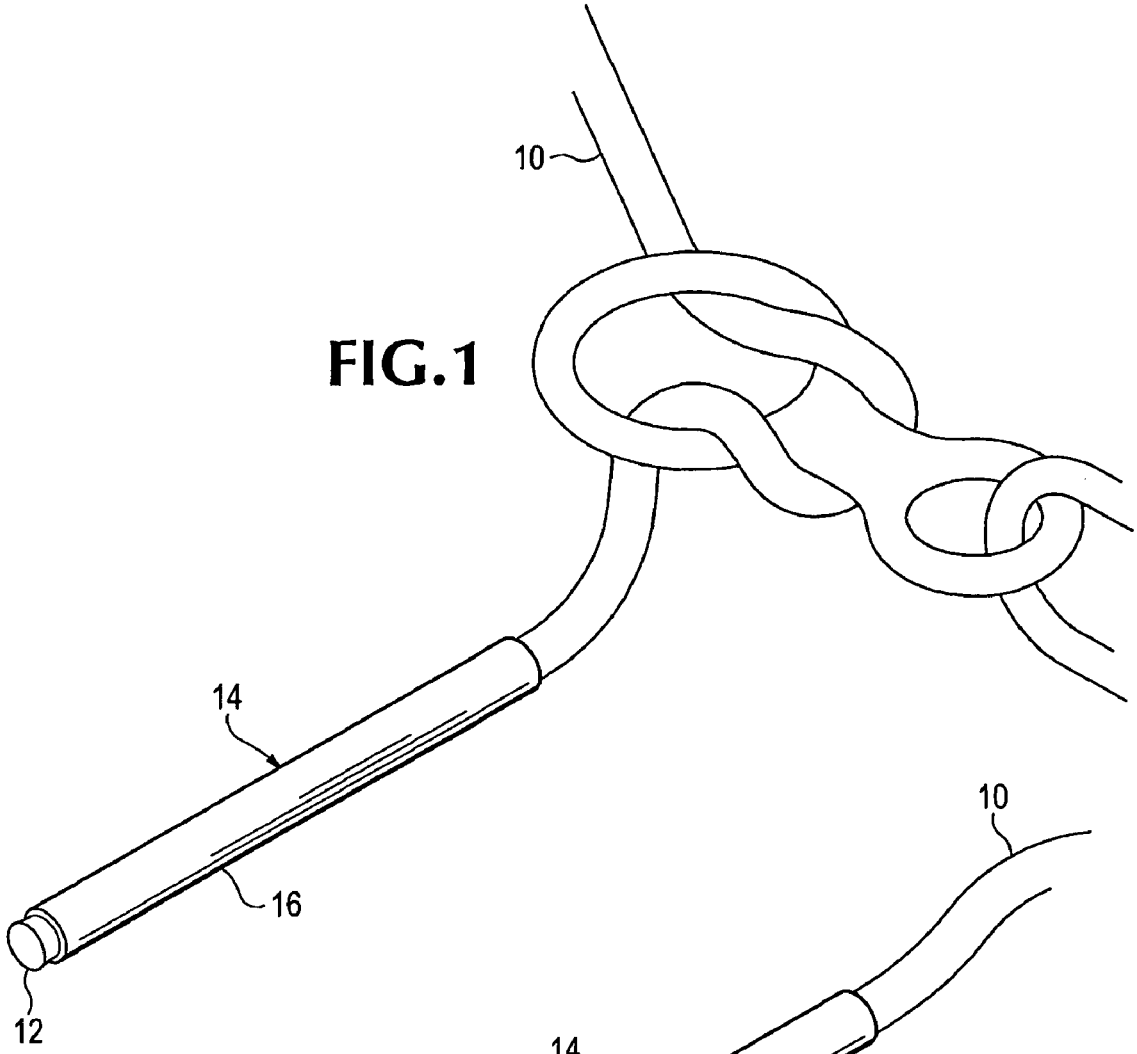
FIG. 1 is a perspective view of a rope embodying the subject invention used in conjunction with a rappelling device.
Figure 2:
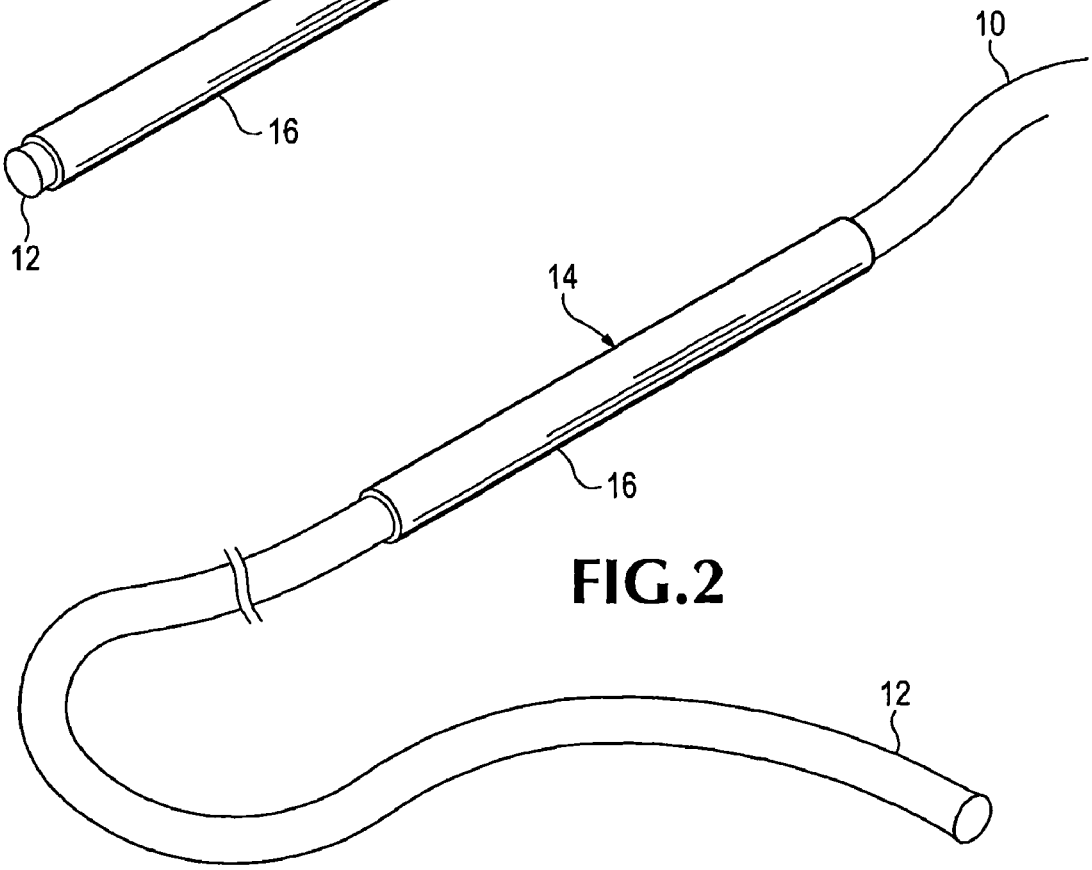
FIG. 2 is a perspective view of a rope showing another embodiment of the invention.

Referring now to FIG. 1 of the drawings, a rope 10 has an end 12 which typically will be the bottom of the rope when the rope is deployed substantially vertically for use in rock or mountain climbing, or for suspending a window cleaner or similar maintenance person from the top of a building. A stiffening mechanism 14 is applied to the rope at or near its bottom end to indicate to someone traveling down the rope that they are approaching the end of the rope. The stiffening mechanism is applied to a short segment of the rope which is long enough to serve the intended purpose but short enough that it does not impede the use of the rope. For example, it needs to be long enough to jam in a rappelling, belaying or positioning device or a friction knot but short enough to pull through a carabiner. For ropes used for climbing purposes, this typically would be three to six inches. However, with ropes used for other purposes the stiffened segment could be much shorter or much longer. The stiffened segment will normally will be located at the end of the rope, FIG. 1, but it often will be desirable for it to be located slightly before the end of the rope, FIG. 2. Again, for climbing ropes the stiffened segment would normally be within three feet of the end of the rope but it could be much further from the end for ropes used for other purposes. The drawings show the stiffening mechanism 14 applied to only one end of the rope, but it typically would be applied to both ends.

Figure 3:
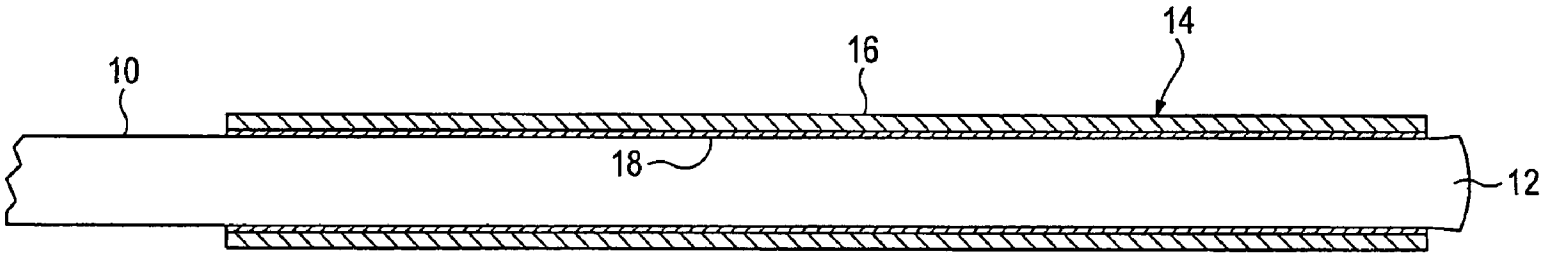
FIGS. 3-9 are cross-sectional view of ropes showing different embodiments of the invention.
Figure 4:
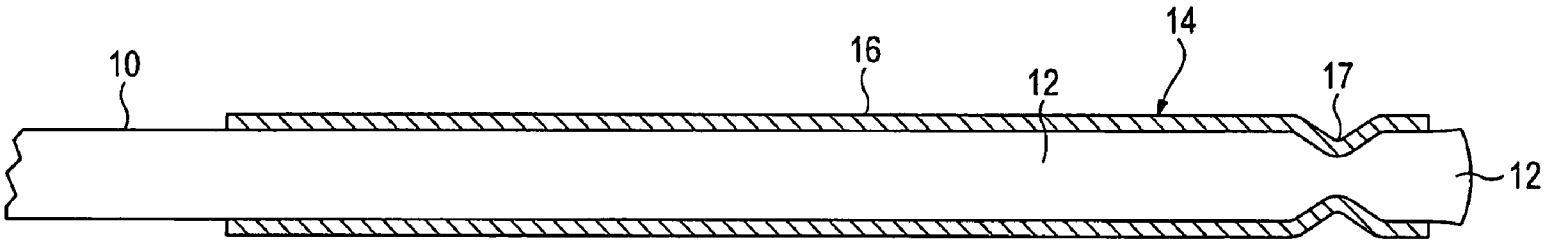
Figure 5:
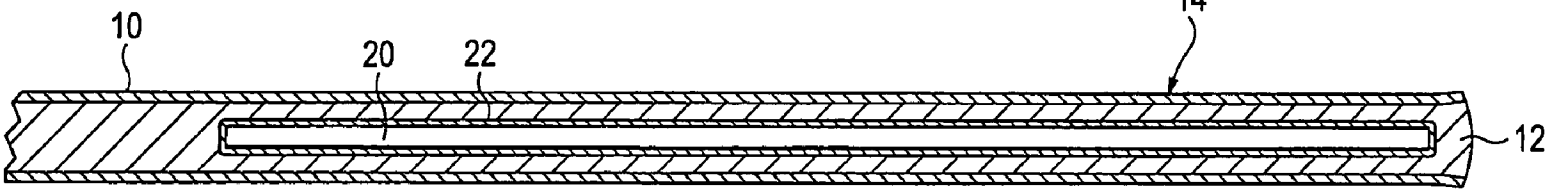
Figure 6:
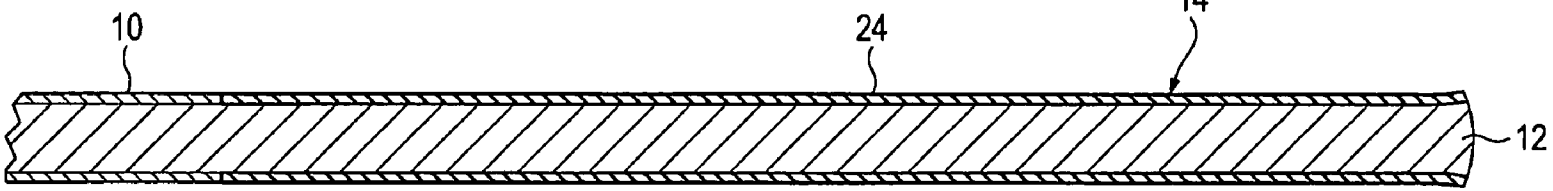
Figure 7:
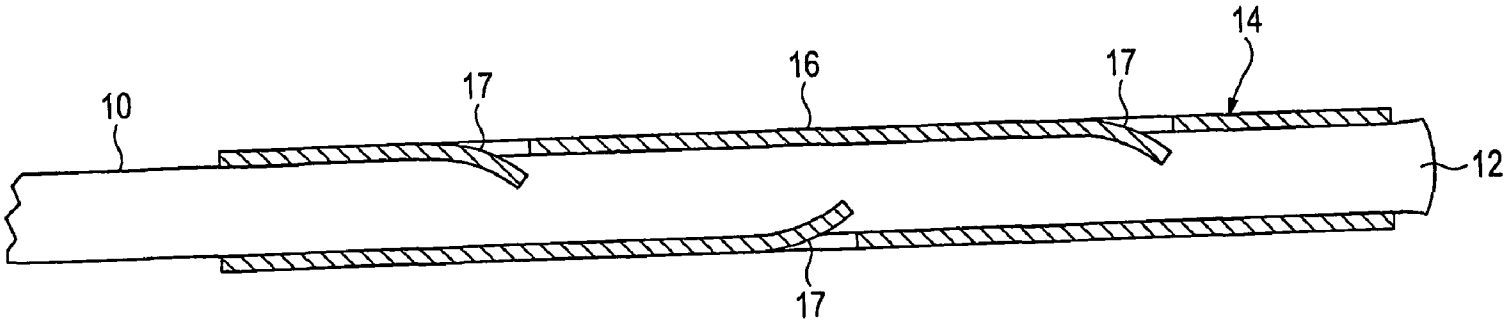
Figure 8:
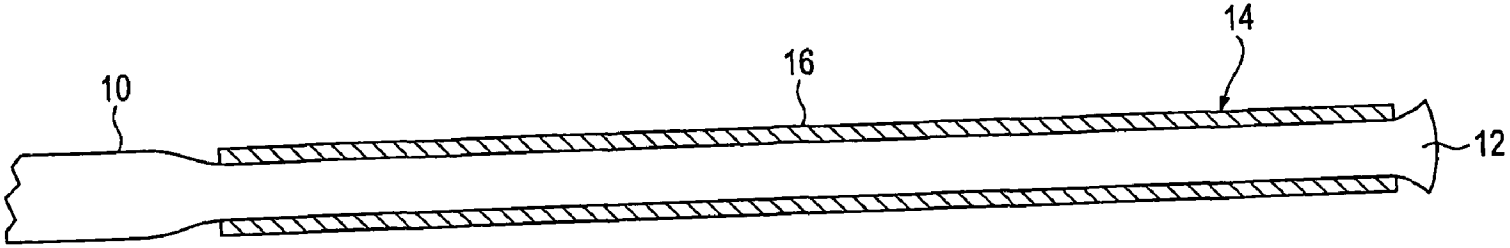
Figure 9:
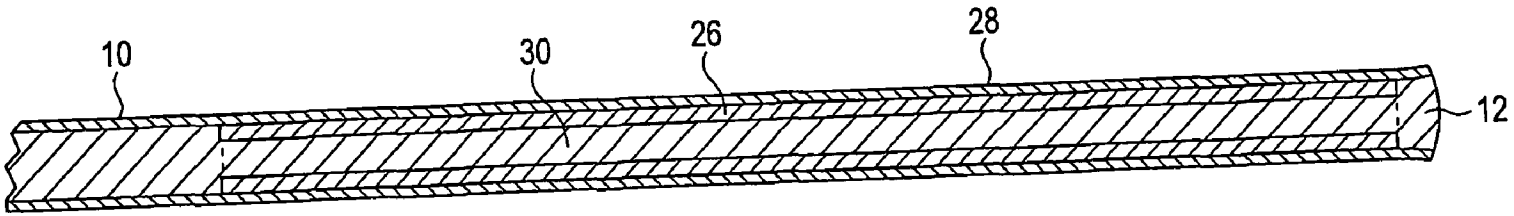

The stiffening mechanism can take many forms. Referring now also to FIG. 3, a collar 16 has an inside dimension which allows the rope to be pulled through it without being so loose that it moves easily along the rope. The collar 16 is made from a relatively rigid material, such as plastic or metal. The collar can be attached to the rope at the desired location with an adhesive 18. The adhesive can be applied to the collar before it is placed on the rope or it can be injected between the collar and the rope when the collar is in place. If the collar is metal it also can be attached to the rope by placing a crimp 17 in the collar with a crimping tool after it is located on the rope, FIGS. 4 and 7. In another embodiment, shown in FIG. 5, the stiffening mechanism is a rod 20 which is embedded in the rope. Typically, the rod would be imbedded in the rope when the rope is being made but it could be embedded later. The rod can be held in place simply by the rope braiding being draw tightly around it, or it could be held in place by an adhesive 22. The rod is made from a substantially rigid material such as metal or plastic. Referring now to FIG. 6, in another embodiment the stiffening mechanism is the fibers 24 which comprise the outer surface of the rope being stiffened. This can be accomplished by impregnating the fibers with an adhesive. If the rope is made from a synthetic heat sensitive material a segment of the rope can be stiffened by applying heat and possibly a compressive force to the segment. In another embodiment, FIG. 8, the entire collar 16 is squeezed with a crimping tool to where its outer diameter is close to the outer diameter of the rope 10. This allows the stiffened segment to have essentially the same diameter as the rest of the rope. In FIG. 9 the collar 26 has a smaller diameter and is placed between the outer sheath 28 and inner core 30 of the rope. While the various types of stiffening mechanisms are described separately, multiple stiffening devices could be used together. For example, a collar could be attached both by crimping and by an adhesive.

In any event, once the stiffening mechanism has been applied to the rope the rope is used in the normal manner. When someone is descending the rope, the stiffened segment will warn them as they approach the bottom of the rope. If the rope is being used in conjunction with a rappelling, belaying or positioning device or a friction knot, when the stiffened segment reaches the device it will be unable to pass through it and the user knows they are approaching the end of the rope. In either case, unlike a knot or a series of knots, the stiffening mechanism 14 cannot be inadvertently forgotten or not tightened, leaving a false sense of security to the person using the rope. In addition if a climber is tied to the end of the rope the stiffened segment will prevent this knot from working its way off of the end of the rope.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A device for indicating the approach of the end of a rappelling or belaying rope, comprising:

(a) a rope having an end;

(b) a stiffening mechanism which is applied to a segment of said rope near but separated from said end;

(c) said stiffening mechanism causing said segment to be sufficiently stiff and have a sufficient length such that said segment will not significantly bend and that a person moving along said rope toward said end will perceive said segment;

(d) wherein said stiffening mechanism is immovable along said rope.

2. The indicating device of claim 1 wherein said stiffening mechanism has a length of three inches to six inches.

3. The indicating device of claim 1 wherein said stiffening mechanism is located within at least three feet from the end of the rope.

4. The indicating device of claim 1 wherein said stiffening mechanism is substantially rigid collar which fits over said rope.

5. The indicating device of claim 4 wherein said collar is affixed to said rope by an adhesive.

6. The indicating device of claim 4 wherein said collar is made from a plastic material.

7. The indicating device of claim 4 wherein said collar is metal.

8. The indicating device of claim 7 wherein said collar is crimped to affix it to said rope.

9. The indicating device of claim 1 wherein said stiffening mechanism is a rod which is inserted into said rope.

10. The indicating device of claim 9 wherein said rod is affixed to said rope by an adhesive.

11. The indicating indicia of claim 1 wherein said stiffening mechanism is a collar which is placed between an outer sheath and an inner core of said rope.

12. The indicating device of claim 1 wherein the rope is made from strands or woven fibers and the stiffening mechanism is the fibers in said segment being adhered to one another by an adhesive.

13. The indicating device of claim 1 wherein the rope is made from strands or woven fibers and said stiffening mechanism is the fibers in said segment being adhered to one another by application of heat.

14. A method for rappelling down a rope comprising:

(a) providing the device of claim 1 which comprises a rope having a stiffening mechanism on a segment thereof proximate an end of said rope;

(b) deploying said rope down a wall to be rappelled with said stiffening mechanism being at the bottom of said rope;

(c) rappelling down said rope until reaching said stiffening mechanism; and (d) discontinue rappelling down said rope.

* * * * *